US005957182A

United States Patent [19]

Ahlberg

[11] Patent Number: 5,957,182

[45] Date of Patent: Sep. 28, 1999

[54] END SECTION ARRANGEMENT RELATED TO A DISPLAY UNIT

[76] Inventor: Erik Ola Ahlberg, S : t Eriksgatan 109, 113 31 Stockholm, Sweden

[21] Appl. No.: 08/983,262

[22] PCT Filed: Jul. 10, 1996

[86] PCT No.: PCT/SE96/00934

§ 371 Date: Jan. 12, 1998

§ 102(e) Date: Jan. 12, 1998

[87] PCT Pub. No.: WO97/03431

PCT Pub. Date: Jan. 30, 1997

[30] Foreign Application Priority Data

Jul. 12, 1995 [SE] Sweden ..... 9502582

[51] Int. Cl.[6] ..... A47G 5/00

[52] U.S. Cl. ..... 160/135; 160/352

[58] Field of Search ..... 160/135, 351, 160/352; 52/720.1, 781, 780, 775, 282.1, 726.1, 726.3, DIG. 4, DIG. 13; 40/605, 606, 610

[56] References Cited

U.S. PATENT DOCUMENTS 4,865,111 9/1989 Perutz .
4,979,554 12/1990 Nelson .
5,058,359 10/1991 Lindblom ..... 160/135 X
5,388,382 2/1995 Brooks ..... 160/135 X
5,439,043 8/1995 Carter .
5,611,384 3/1997 Carter ..... 160/135

FOREIGN PATENT DOCUMENTS

WO 95/10104 4/1995 WIPO .

*Primary Examiner*—David M. Purol
*Attorney, Agent, or Firm*—Burns, Doane, Swecker & Mathis, LLP

[57] ABSTRACT

The invention relates to a display unit end section, wherein the end section has a closed, curved cross-sectional shape and is comprised of a bendable sheet having mutually opposite edge portions which are each provided with a first coupling element forming part of the respective two-part coupling mechanism. Respective second corresponding coupling elements of the two-part coupling mechanism are attached to a rail. The rail includes a first coupling element of a further two-part coupling mechanism adapted for coaction with a corresponding second coupling element placed on the edge-part of the display unit.

8 Claims, 1 Drawing Sheet

Fig. 1
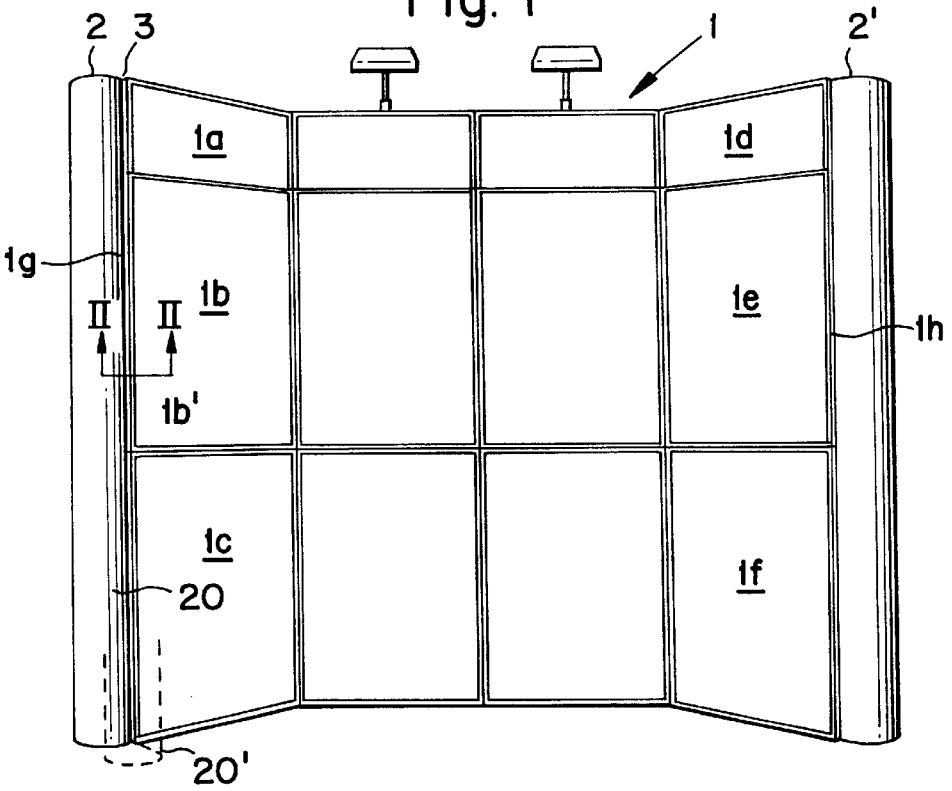
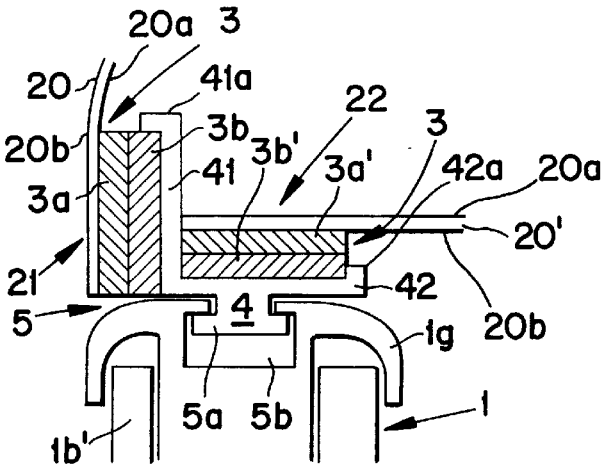
Fig. 2
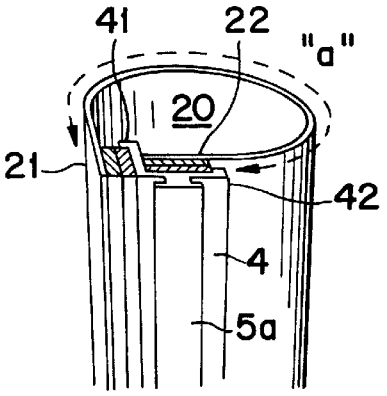
Fig. 3
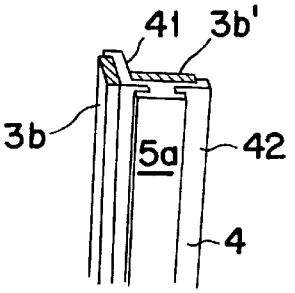
Fig. 4

END SECTION ARRANGEMENT RELATED TO A DISPLAY UNIT

FIELD OF THE INVENTION

The present invention relates to a display unit and more particularly to an end section that can be adapted for simple coaction with the edge-part of the display unit.

More particularly, the end section adapted for coaction with an edge part of a display will have a curved and closed form when seen in cross-section, formed from a bendable sheet having mutually opposing edge-parts provided with coupling elements that form part of a two-part coupling means.

DESCRIPTION OF THE BACKGROUND ART

It is known in the art to construct a display unit with integrated end sections that have a curved and closed form in cross-section.

By way of example of the known prior art, reference is made to the disclosures made in International Patent Application PCT/SE94(00905 (Publication No. WO 95/10104). This publication describes and illustrates a picture or image display unit which is comprised of a picture-supporting sheet-like carrier whose outer shape is such as to form two mutually opposing edges, wherein the carrier has a rigidity and flexibility such as to enable the carrier to be readily curved.

Each of the aforesaid edges shall be adapted to form a first part of a two-part coupling means and/or such as to coact with a first part of a two-part coupling means, of which the other part is fastened to the carrier at a distance from said edge.

There is thus formed an edge-orientated carrier section and the aforesaid distance is so adapted as to enable the carrier section to be brought to an essentially tubular configuration within the confines of said distance for mutual coaction between the first and the second parts of the coupling means, wherein two lateral tubular configurations and their allotted and integrated edge-related carrier sections serve as supports for a central carrier section orientated therebetween.

Other types of display units of the kind to which the present invention relates and which can be easily erected or developed and collapsed and where separate section-embracing frames within display unit form a flexurally rigid unit are also known to the art.

Display units of this kind are comprised of a number of sections where each section is delimited by a flexurally rigid sheet or panel holding frame structure.

An example of a construction of the aforesaid kind is described and illustrated in FIG. 1 of the European Patent Application 92 91 2282.8, which relates to a system sold under the trade designation "Original 8" by Maxibit AB, Stockholm, Sweden.

SUMMARY OF THE PRESENT INVENTION

TECHNICAL PROBLEMS

When considering the earlier state of the art as described above, it will be seen that a technical problem is one of creating conditions with the aid of simple means that will enable a readily erectable and dismountable display unit that comprises a number of flexurally rigid sections to be readily supplemented with one or two end sections that have a curved and closed form in cross-section.

It will also be seen that a technical problem is one of providing with the aid of simple means end sections that have a closed circular cross-section, where the end section is comprised of a bendable sheet and a rail.

It will also be seen that another technical problem is one of providing with the aid of simple means conditions which will enable a sub-section of an end section to be applied to laterally positioned sections of an edge-related frame of the display unit in line with an exposable front surface of an adjacent section.

It will also be seen that a technical problem is one of providing an end section which will enable another sub-section to define right angles with a front surface belonging to the section when required and without modifying the construction.

In the case of an end section comprised of a bendable sheet having mutually opposed edge-parts which are each provided with a first coupling element of a respective two-part coupling means, it will be seen that a technical problem resides in creating conditions whereby respective other corresponding coupling elements of respective two-part coupling means can be fastened to a rail, and to realize that the rail shall have a first coupling element that forms part of a further two-part coupling means adapted for coaction with a corresponding second coupling element of said further coupling means, and that said second coupling element shall be provided on an edge-part of the display unit; and more particularly an edge-part of one or more edge-orientated sections.

It will also be seen that a technical problem lies in realizing the significance of positioning said second coupling elements of the two coupling-means at an angle on the rail.

It will also be seen that a technical problem resides in the significance of and the advantages afforded by using a rail of L-shaped cross-section with one of said coupling elements placed within or on the inside of the L-shape and one coupling element placed outside the L-shape.

It will also be seen that a technical problem is one of realizing the advantages that are afforded in this latter case when the first and the second coupling elements are comprised of permanently magnetized strips.

Another technical problem is one of realizing the significance of and the advantages afforded by mounting the first coupling elements for respective opposing sheet edge-parts on a respective side of the sheet and adapting the first coupling element for vertical orientation.

It will also be seen that a technical problem is one of realizing the significance of spacing the first edge-related coupling elements apart at a distance of between 20 and 50 cm, so as to enable the cross-section of the end section to be adapted to the shape, size and orientation of the display unit.

It will also be seen that a technical problem is one of realizing the significance of and the advantages afforded by adapting the thickness of a first coupling element and the thickness of a second coupling element to or essentially to the thickness of a sheet adapted to the edge section of the display unit.

SOLUTION

With the intention of solving one or more of the aforesaid technical problems, the present invention takes as its starting point a known display unit adapted end section having a curved and closed cross-sectional shape, and applying these features to a display unit having flexurally rigid sections, where the end section is comprised of a bendable sheet having mutually opposed edge-parts which are each provided with first coupling elements of a respective two-part coupling means.

Having an end section which is separate from the display unit and which can be readily fitted to and dismantled from said display unit as a supplementary part thereof, the present invention teaches that respective second corresponding coupling elements of respective coupling means are attached to one and the same rail and positioned in close relationship, wherein the rail also carries a first coupling element of a further two-part coupling means having a corresponding second coupling element for the edge-part of the display unit allocated to said further coupling means.

In accordance with proposed embodiments that lie within the scope of the inventive concept, it is proposed that the second coupling elements of respective two-part coupling means are positioned at an angle in the rail.

The rail will preferably have an L-shape and one of the coupling elements will be positioned within the L-shape and one coupling element will be positioned outside the L-shape, wherein the legs of the L-shape are provided with projections.

The first and the second coupling elements may be comprised of permanently magnetized strips, wherein the magnetization will preferably be adapted for positional orientation of the coupling elements relative to one another.

The first coupling elements for respective opposing edge-parts of the sheet are mounted on a respective side thereof at a mutual distance between said first edge-related coupling elements of between 20 and 50 cm.

The thickness of a first coupling element and the thickness of a second coupling element is adapted, or at least essentially adapted, to the thickness of a sheet adapted to the edge-section of the display unit.

ADVANTAGES

Those advantages that are primarily afforded by an inventive edge-section arrangement reside in the provision of conditions which will enable an end-section having a curved and closed shape in cross-section to be fitted as a separate unit to an erectable and dismountable display unit having flexurally rigid sections so as to enable end-related sections to be readily mounted when the display unit is erected, wherein the end-section may comprise a bendable sheet that can be rolled and whose opposing edge-parts are each provided with first- coupling elements forming part of a respective two-part coupling means, wherein corresponding second coupling elements are attached to a rail, and wherein the rail has an L-shaped cross-section and can be brought into coaction with the edge -surface of end-related, vertically extending sections within the display unit through the medium of a further coupling means.

The main characteristic features of an inventive display unit end section are set forth in the characterizing clause of the following claim 1.

BRIEF DESCRIPTION OF THE DRAWING

The invention will now be described in more detail with reference to a proposed exemplifying embodiment thereof and also with reference to the accompanying drawing, in which

| | |
|---|---|
| FIG. 1 | is a perspective view of an erected or developed earlier known display unit in which mutually opposing end parts have each been provided with an inventive end section capable of being readily fitted to and removed from the display unit; |
| FIG. 2 | is a cross-sectional view taken on the line II—II in FIG. 1 which illustrates the coupling means required within the end section and between the end section and said edge part; |
| FIG. 3 | is a perspective view of an end section which comprises a bendable sheet whose opposing edge-parts are each provided with a first coupling element of a respective two-part coupling means for coaction with an L-shaped rail; and |
| FIG. 4 | is a perspective view of the L-shaped rail. |

DETAILED DESCRIPTION OF A PREFERRED EMBODIMENT

The present invention relates to an end section arrangement having a curved and closed cross-section and intended for display units.

Shown in FIG. 1 is a display unit 1 to which readily removable end sections 2, 2' are fitted and which is comprised of a number of display sections disposed in rows and columns. The number of sections used and the shape of one or more sections may vary within wide limits and since a detailed description of these display sections is unnecessary in obtaining an understanding the invention, it suffices to say that the sections 1*a*, 1*b* and 1*c* are positioned at the left edge of the display unit as seen in the Figure, while the sections 1*d*, 1*e* and if are placed on the right edge of the unit. The sections 1*a*, 1*b* and 1*c* have a common edge 1*g* which lies distal from and opposite to a common edge 1*h* of the sections 1*d*, 1*e* and 1*f*.

The display unit 1 is of a known kind that includes display sections which can be readily collapsed and extended.

Since the display unit 1 is known to the art, for instance from the display unit sold by Maxibit AB, Stockholm, Sweden, under the designation "Original 8", the unit will not be described in more detail here.

Because the common edge 1*g* is identical to the common edge 1*h*, the following description is given solely with reference to one of the end sections, namely the end section 2, and the coaction of the end section 2 with the common edge 1*g*.

The end section 2 will now be described in more detail with reference to FIGS. 2, 3 and 4. The end section 2 is comprised of a unit which is separate from the display unit 1 and which is constructed from a sheet 20 which can be readily rolled to a generally tubular shape. The mutually distal edge portions 21, 22 of the sheet are shown joined together and in coaction with a rail 4.

Each of the edge portions 21, 22 of the sheet 20 includes a first coupling element 3*a*, 3*a*' belonging to a respective two-part coupling means 3, 3'.

Respective, corresponding coupling elements 3*b*, 3*b*' of said two-part coupling means 3, 3' are attached to the rail 4 in a manner described in more detail here below.

In addition, the rail 4 is provided with a first coupling element 5*a* that belongs to a further two-part coupling means 5, and a corresponding second coupling element 5*b* of said further coupling means 5 is mounted on the common edge portion 1*g* of the display unit.

The first coupling element 5*a* is formed by two parallel channels and the second coupling element 5*b* has the form of a constricted slot-like opening whose defining edges are intended for slidable coaction with said parallel channels.

When the display unit 1 is erected, the rail 4 can be pushed down along the common edge-part 1*g* and therewith bind the sections 1*a*, 1*b* and 1*c* together.

With regard to the cross-sectional shape of the rail 4, it can be mentioned that the second coupling elements 3*b*, 3*b*' of respective two-part coupling means 3, 3' are positioned at right angles in the rail 4.

The rail 4 has an L-shaped cross-section and one of said coupling elements 3*b*40 is positioned within or on the inside of the L-shape, and one coupling element is placed externally of or on the outer surface of the L-shape, and more particularly on a respective leg 41, 42 of the L-shaped rail 4.

The legs 41, 42 of the L-shaped rail are provided with small projections 41*a*, 42*a* which form coupling element supports and also protect said elements.

The first and the second coupling elements 32*a*, 3*b* and 3*a*', 3*b*40 respectively are comprised of permanently magnetized bands or strips which extend along the full length of the rail 4.

It shall be possible to divide the rail 4 into a number of sections having a length corresponding to or shorter than the vertical extension of the sections 1*a*, 1*b* or 1*c*.

The permanent magnetization is adapted to provide precise positioning of the coupling elements in relation to one another.

The coupling elements 3*a* and 3*a*' of each opposing edge-part 21, 22 are shown mounted to their respective sides 20*a*, 20*b* of the sheet 20.

The two first edge-related coupling elements 3*a*, 3*a*' extending transversely on the sheet are spaced apart at a distance of between 20 and 50 cm.

The vertical extension, or length, of the sheet 20 may correspond to the vertical extension of the sections 1*a*, 1*b* and 1*c* and the width of the sheet is large enough to provide an end section of desired shape.

The width of the sheet 20 (the transverse extension of the sheet) may be chosen in accordance with the shape and structure of the display unit.

The thickness of the first coupling element 3*a* and the thickness of the second coupling element 3*b* are adapted to, or essentially to, the thickness of a sheet or panel 1*b*' included in the display unit 1 and fitted in the frame structure.

An end-part of an erected display unit 1 having sections which are delimited by the frame structure and having a sheet or panel mounted within respective frame structures is conveniently formed by attaching the rail 4 to the common edge surface 1*g* of the sections 1*g*, 1*b* and 1*c* through the medium of the further coupling means 5, by pushing the first coupling element 5*a* into coaction with the second coupling element 5*b*.

The first coupling element 3*a* is then applied to the corresponding second coupling element 3*b* and the sheet 20 is curved so as to bring the first coupling element 3*a*' into coaction with the second coupling element 3*b*'.

It will be noted that the rail 4 can be attached to the common edge-part 1*g* of the display unit 1 in a reversed (upside down) position, wherewith the part-section 20 ' of the bendable sheet 20 is able to form right angles with the plane of the sheet or panel 1*b*', as shown in more detail in FIG. 1 in broken lines.

Although the legs 41, 42 of the illustrated L-shaped rail are at right angles to one another, it will be understood that the inventive thought also includes other angles, such as angles of 45–135°, and/or some other cross-sectional shape.

It will be understood that the coupling means 3, 3' and 5 described in the aforegoing do not restrict the scope of the invention and that similar coupling means or other dissimilar coupling means can be used within the scope of the inventive concept.

The invention is, of course, not restricted to the aforedescribed and illustrated exemplifying embodiment thereof, since modifications can be made within the scope of the invention as defined in the following claims.

I claim:

1. A display unit end section having a closed, curved shape in cross-section, said end section comprising:

a bendable sheet having opposing edge portions which each carry a first coupling element of a respective two-part coupling means, second, corresponding coupling elements of said respective two-part coupling means attached to a rail, said rail having legs defining an angle formation and said rail including a further first coupling element of a further two-part coupling means, and said further first coupling element of said further two-part coupling means being adapted for cooperation with a corresponding further second coupling element of said further coupling means formed by an edge-part of the display unit; and wherein the second coupling elements of said respective two-part coupling means are positioned, relative to one another, at an angle which generally corresponds to the angle formation of the rail; and wherein the rail has an L-shaped cross section, and one of said coupling elements of said respective two-part coupling means is positioned within the L-shape and one of said coupling elements of said respective two-part coupling means is positioned outside the L-shape.

2. An end section according to claim 1, wherein legs of the L-shape rail are provided with projections.

3. An end section according to claim 1, wherein the first and the second coupling elements of said respective two-part coupling means are permanently magnetized strips.

4. An end section according to claim 3, wherein the permanently magnetized strips provide for positioning of the coupling elements of said respective two-part coupling means relative to one another.

5. An end section according to claim 1, wherein the first coupling element on each opposing edge portion is mounted on a respective side of said sheet.

6. An end section according to claim 1, wherein the first coupling elements of said respective two-part coupling means are spaced apart at a distance of between 20 and 50 cm.

7. An end section according to claim 1, wherein a thickness of said first coupling element and a thickness of said second coupling element of said respective two-part coupling means are selected based upon a thickness of a display unit sheet.

8. An end section according to claim 3, wherein the first coupling element on each opposing edge portion is mounted on a respective side of said sheet.

* * * * *